United States Patent [19]

Simmons et al.

[11] Patent Number: 5,007,770

[45] Date of Patent: Apr. 16, 1991

[54] METHOD AND APPARATUS FOR CONSTRUCTING A SUBSURFACE RETAINING WALL

[76] Inventors: Robert J. Simmons, 27308 Airvfen Ave., Hayward, Calif. 94542; Key S. Kwak, 419 Beverly Pl., Castro Valley, Calif. 94546

[21] Appl. No.: 445,373

[22] Filed: Dec. 4, 1989

[51] Int. Cl.[5] ..... E02D 5/56

[52] U.S. Cl. ..... 405/240; 405/236; 405/267; 37/81

[58] Field of Search ..... 405/266, 267, 232, 233, 405/236, 240, 241, 243, 245, 253; 175/171, 173, 307, 402; 37/81

[56] References Cited

U.S. PATENT DOCUMENTS

| | | | |
|---|---|---|---|
| 2,693,087 | 11/1954 | Quillinan | 405/253 |
| 3,604,214 | 9/1971 | Turzillo | 405/241 |
| 3,690,109 | 12/1972 | Turzillo | 405/241 |
| 4,202,416 | 5/1980 | Blaschke et al. | 405/232 X |
| 4,249,836 | 2/1981 | Schmednecht | 405/267 |
| 4,662,792 | 5/1987 | Gessay | 405/241 X |
| 4,886,400 | 12/1989 | Taki et al. | 405/267 |

FOREIGN PATENT DOCUMENTS

| | | | |
|---|---|---|---|
| 165319 | 12/1980 | Japan | 405/243 |

*Primary Examiner*—Dennis L. Taylor
*Assistant Examiner*—J. Russell McBee
*Attorney, Agent, or Firm*—Linval B. Castle

[57] ABSTRACT

One or more rotating augers with drilling heads are aligned within a rectilinear casing with a rectilinear cutting head defining one of a plurality of adjacent vertical slots that may be excavated to within about one inch of an adjacent structure or property without encroaching. When a slot is completed it is filled with either a precast or poured-in-place wall element, a plurality of adjacent elements being joined at the edges to form a solid wall without need for forms and shoring or underpinning of the adjacent property or structure.

8 Claims, 2 Drawing Sheets

METHOD AND APPARATUS FOR CONSTRUCTING A SUBSURFACE RETAINING WALL

BRIEF SUMMARY OF THE INVENTION

This invention relates to the construction of concrete wall structures and particularly to the method and apparatus for the excavation and installation of subsurface retaining walls without disturbing the property line or closely adjacent structures.

The term, subsurface retaining walls, as used herein refers to walls that are usually vertical and which extend from grade level down to twenty or more feet below grade. These may be used, for example, as foundation walls or the walls of subterranean garages or basements of large buildings. Because the walls may be installed within one inch from a property line or adjacent building, the system to be described is of particular value in costly high density areas.

The conventional method of constructing such a retaining wall is to construct a shoring system sufficiently distant from the adjacent property to eliminate the possibility of encroachment. If it is desired to eliminate this costly distance to adjacent property lines, the alternative is to obtain permission to construct a temporary shoring or underpinning system that encroaches on the adjacent property. Such permission is usually very difficult and costly to obtain, and shoring and underpinning systems are costly as well as very time consuming to install.

The system to be described permits the construction of a subsurface retaining wall to within one inch or less from the property line or adjacent structure without costly shoring or underpinning and without danger to adjacent property or structures and without the need for wall forms.

Very briefly described the system includes the excavation of a line of individual vertical "slots" to the desired depth in the soil along the path of the wall and installing either precast or poured-in-place structural elements into each of the slots. When the several elements are joined into a solid wall, the excavation of the soil adjacent to the new wall may then take place. The method thus allows the wall to be installed without need to construct costly and time consuming underpinning systems when a new structure is to be constructed adjacent an existing structure at a level substantially lower than the foundation of the existing structure, and allows the construction of the wall along a property line without need for temporary support shoring for the adjacent property.

The apparatus for excavating the vertical slots includes one or more rotatable drill shafts, each with a continuous-flight auger and a circular cutting head. Each shaft and auger is encased in its own tubular casing or duct and all ducts are aligned within a single integral casing having at the bottom edge a rectilinear cutter defining the cross section of the area or slot to be excavated. The auger removes the soil from the hole being excavated by the drills and, in soft or sandy soil, slurry ducts extending to a point near the bottom of the integral outer casing are used to pump cement slurry into the bottom of the excavation as the drills and integral casing are being withdrawn.

BRIEF DESCRIPTION OF THE DRAWINGS

In the drawings which illustrate the preferred embodiment of the invention.

DETAILED DESCRIPTION

Figure 1:
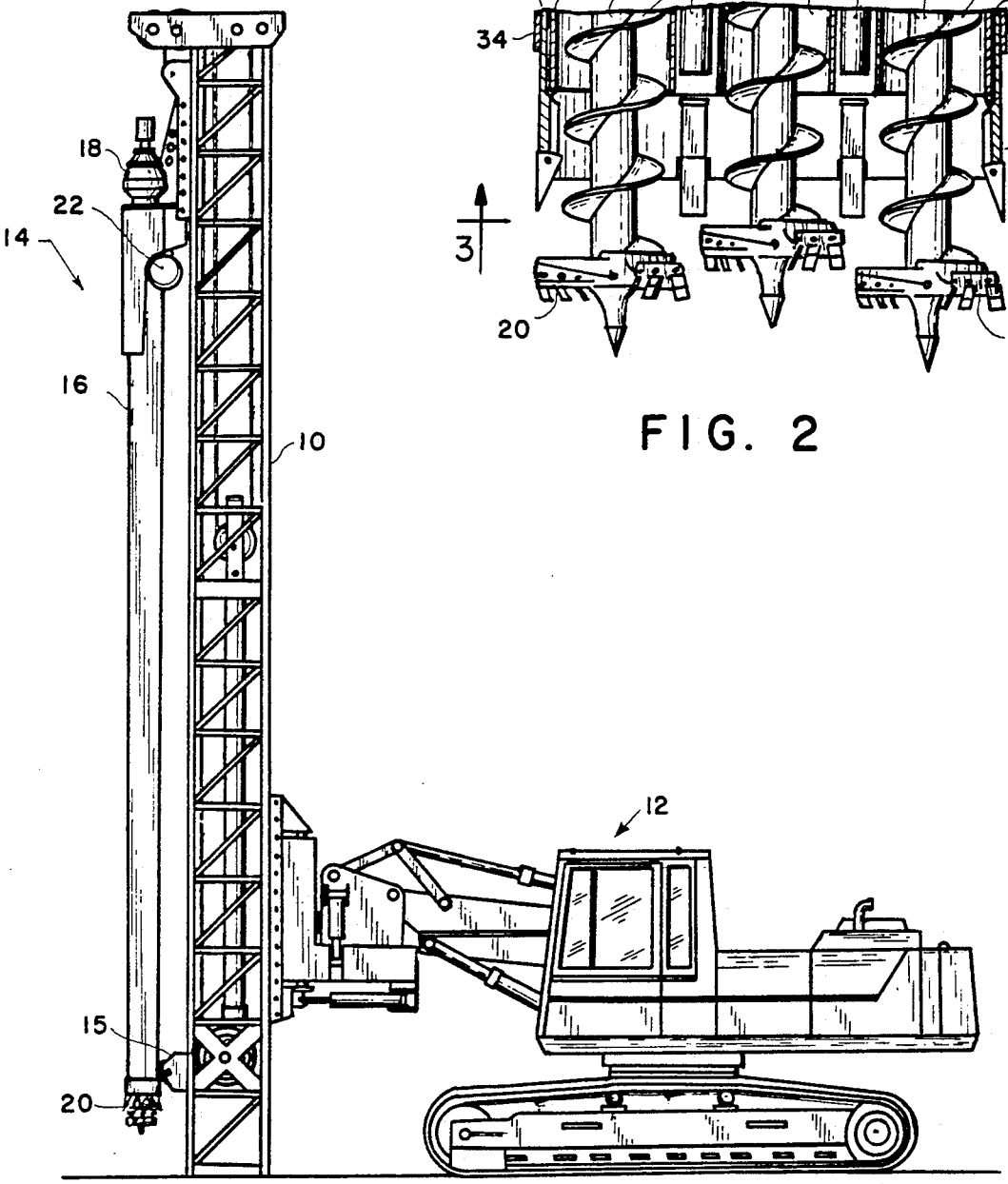
FIG. 1 is an elevational view of drilling equipment for excavating vertical wall slots in accordance with the invention.

Illustrated in FIG. 1 is a derrick 10 being supported in a vertical position by a mobile power source 12 for accurately positioning the derrick and aligning the drilling system 14 supported by the derrick, and for supplying the necessary power required by the drilling system.

The drilling system 14, shown vertically suspended from the top of the derrick 10 and centered against the roller brace 15 attached near the base of the derrick, includes a casing 16 having a rectilinear cross section, and one or more drill shafts each with a continuous-flight auger rotatable within its own tubular casing. Each shaft is rotated by a motor 18 coupled to the top of the integral casing and each shaft has a rotatable cutting head 20 at the lower end. When the system 14 is lowered and the shafts rotated so that the cutting heads 20 begin to cut the soil, the auger on the shaft will lift the spoil thus excavated and discharge it from the waste opening 22.

Figure 2:
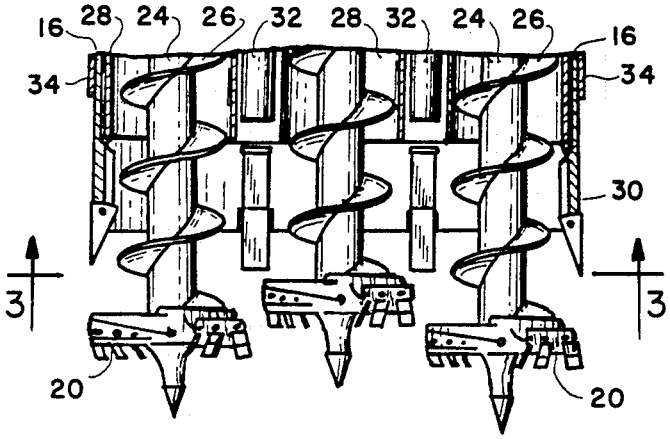
FIG. 2 is an elevational view of the end portion of the drill section for excavating the wall slots.

FIG. 2 illustrates a portion of the lower end of a drilling system containing three drill shafts 24 with augers 26, each contained within a non-rotatable tubular casing 28 (shown in section) and each supporting a rotatable cutting head 20. The three tubular casings 28 are positioned within and closely fit within the rectilinear integral casing 16 shown suspended from the derrick of FIG. 1. A rectilinear cutting head 30 is secured to the bottom end of the rectilinear integral casing 16 that defines the cross section of the rectilinear hole or slot to be excavated by the drill system. The three rotatable cutting heads 20 extend below the rectilinear cutting head and have a diameter greater than the diameters of the augers 26 so that the cutting heads will cut at least to the exterior edges of the rectilinear cutting head. Thus, as the drilling system advances, the rectilinear cutting head 30 carves out the corners and straight sections not reached by the circular cutting heads 20 and the released soil is picked up by the augers 26 and discharges as spoil from the waste opening 22.

Figure 3:
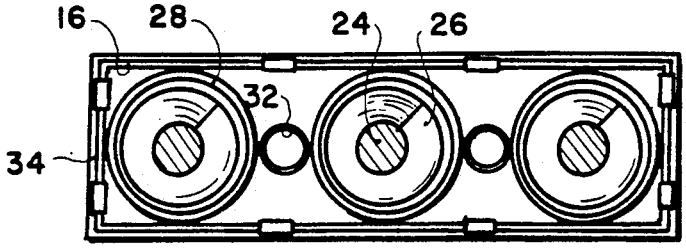
FIG. 3 is a bottom plan view taken along the lines 3—3 of FIG. 2.

FIG. 3 is a bottom plan view of the drilling system taken along the lines 3—3 of FIG. 2 and shows the drill shafts and augers within their respective tubular casings 28 and the tubular casings within the rectilinear integral casing 16. Also illustrated in FIG. 3 are the ends of slurry ducts 32. In many applications, the type of soil and the depth being excavated will enable a full rectilinear slot to be drilled, removed and replaced with a precast or cast-in-place wall section without danger of cave-in, weighted by the drilling system. In many other applications, particularly in a sandy soil, it is necessary to prevent collapse of the excavation by pumping a cement slurry into the excavation as the integral casing 16 and rectilinear cutting head 30 are being withdrawn. The slurry ducts 32 are therefore placed into the integral casing 16 between the tubular casings 28. Thus, as the slurry is pumped into the bottom of the excavation, the entire drill assembly may be withdrawn without the risk of collapsing the excavated hole.

An alternate method to support the excavated holes in collapsible soil conditions is to add a removable telescoping casing around the exterior of the integral casing 16 as shown in FIG. 2. This telescoping casing will advance with the integral casing 16 until the excavation is completed. The drill assembly and integral casing 16 are then removed leaving the telescoping casing 34 supporting the excavation until the permanent structural element, either precast or cast-in-place, has been inserted into the now empty telescoping casing. The telescoping casing 34 may then be withdrawn from the excavation and reapplied to the integral casing 16 for subsequent excavations.

Figure 4:
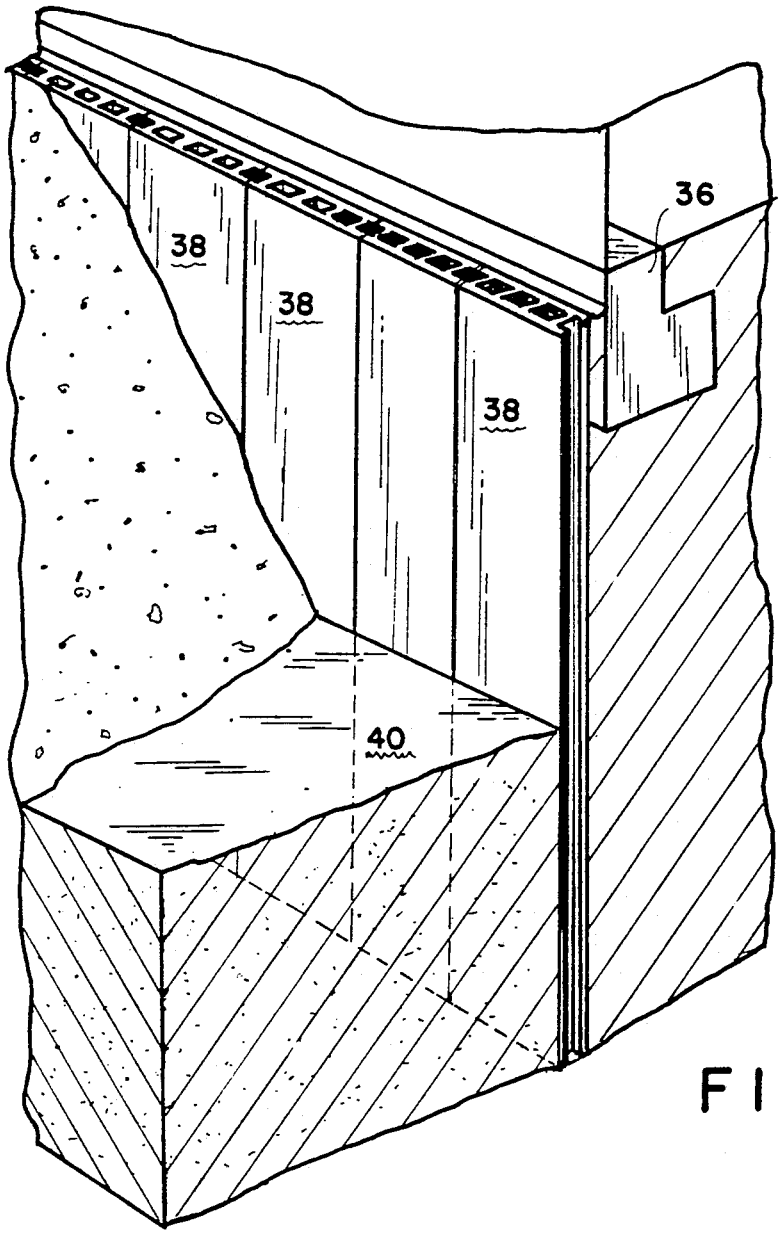
FIG. 4 is a perspective view of an installed precast wall elements forming a subsurface retaining wall.

FIG. 4 is a perspective view typically illustrating the construction of a subsurface wall of precast wall members in rectilinear excavations close to the foundation 36 of an adjacent building.

The complete process of excavation and forming a wall includes the placement of the derrick 10 so that the rectilinear integral casing 16 is properly aligned, parallel to and as close as desired to a property line or structure 34. The motors 18 on each shaft 24 are started so that the cutting heads 20, weighted by the drilling system, begin the excavations, the spoil from the drilling being conveyed by the augers 26 up within the casings 28 to be discharged from the waste opening 22. The rectilinear cutting head 30 at the lower end of the integral casing 16 cuts the soil not reached by the rotating cutting heads 20 and forms the desired excavation with the desired rectilinear cross-section. If a sandy or unstable soil is encountered, the outer surface of the integral casing 16 may be encased with a removable telescoping casing 34 which is left in place after the hole is excavated to the desired depth. The rotating cutting heads, the augers, and the integral casing are then removed. Once the desired precast or pour-in-place structural element has been inserted, the telescopic casing may be withdrawn without the possibility of collapse of the excavation walls.

When one hole has been thus excavated, the derrick 10 is moved to an adjacent position and a new hole is excavated in the same manner, each hole being filled with either a precast structure, such as the structural elements 38 in FIG. 4, or with a poured-in-place material. After a second element 38 has been installed adjacent the first element, the edges are joined to form a solid double-width wall section. This is continued until the desired wall length is achieved.

FIG. 4 illustrates a row of excavations which have been filled with precast structural elements 38. After the elements 38 are in place and are suitably joined together along their edges to form a solid wall, excavation of the soil in front of the wall may take place without danger of soil slippage. The figure illustrates partial excavation of the soil down to a desired finish grade 40. When completely excavated, a permanent floor or surface may then be poured.

I claim:

1. A method for constructing a subsurface retaining wall from existing grade elevations with a plurality of individual wall elements and without use of forms, shoring or underpinning, the method comprising the steps of:

excavating a first rectilinear hole to a depth defining the desired vertical dimension of the wall to be constructed, the width of said rectilinear hole defining the desired thickness of said wall and the horizontal length of said hole defining the horizontal dimension of an individual wall element filling said first hole with a suitable first retaining wall element excavating a second rectilinear hole to a depth defining the desired vertical dimension of the wall to be constructed, said second hole having substantially the same width and length as said first hole, one edge of said second hole being in open communication with the adjacent edge of said first hole and said first retaining wall element, and filling said second hole with a suitable second retaining wall element.

2. The method claimed in claim 1 including the additional step of:

joining together the adjacent edges of said first and said second retaining wall elements.

3. The method claimed in claim 2 wherein said first and said second retaining wall elements are precast elements.

4. The method claimed in claim 2 wherein said first and said second retaining wall elements are poured-in-place concrete.

5. The method claimed in claim 1 wherein said first and second rectilinear holes a formed with an integral casing having at its end a cutting head with a rectilinear cross section defining the shape of the hole to be excavated, said rectilinear cutting head working in coordination with at least one circular cutting head at the end of an auger rotatable within a tubular casing within said integral casing for lifting and disposing of soil waste generated by said rectilinear and said circular cutting heads.

6. The method claimed in claim 5 including the further step of introducing slurry through slurry ducts within said integral casing, said slurry being introduced after completion of an excavated hole and during withdrawal of said integral casing, said circular cutting heads and said augers and said slurry ducts for preventing collapse of said hole.

7. Apparatus for excavating a rectilinear subsurface soil slot with a predetermined depth, thickness and horizontal length, said apparatus comprising:

an elongated rectilinear casing having a cross sectional configuration corresponding to the predetermined thickness and horizontal length of said slot, the lower end of said casing having a rectilinear cutting head;

at least one rotatable drill shaft extending through the length of said casing, said shaft having a rotary cutting head extending from the lower end of said casing and the rectilinear cutting head, said shaft supporting a continuous-flight auger within a tubular casing secured within said elongated rectilinear casing for removal of said waste from the slot; and motor means mounted on the top of said rectilinear casing and coupled to said shaft for rotating said shaft, its rotary cutting head, and the auger within said tubular casing.

8. The apparatus claimed in claim 7 further including positioning and inserting means for precisely locating and aligning said apparatus with the soil slot to be excavated, said inserting means including a driving force produced by the combined weights of said drill shaft, said rotating cutting head, said elongated rectilinear casing and said rectilinear cutting head, said weights being sufficient to advance said apparatus so that said rectilinear cutting head will carve out and displace soil not excavated by said rotary cutting head.

* * * * *